US008978435B2

(12) United States Patent
Viviroli

(10) Patent No.: US 8,978,435 B2
(45) Date of Patent: Mar. 17, 2015

(54) WIRE STRAIGHTENING APPARATUS

(75) Inventor: Stefan Viviroli, Horw (CH)

(73) Assignee: Komax Holding AG, Dierikon (CH)

( * ) Notice: Subject to any disclaimer, the term of this patent is extended or adjusted under 35 U.S.C. 154(b) by 809 days.

(21) Appl. No.: 13/167,124

(22) Filed: Jun. 23, 2011

(65) Prior Publication Data

US 2011/0315266 A1 Dec. 29, 2011

(30) Foreign Application Priority Data

Jun. 23, 2010 (EP) ..... 10167053

(51) Int. Cl.
*B21D 1/02* (2006.01)
*B21F 1/02* (2006.01)
*B65H 57/14* (2006.01)

(52) U.S. Cl.
CPC . *B65H 57/14* (2013.01); *B21F 1/02* (2013.01)
USPC ..... 72/160; 140/147

(58) Field of Classification Search
CPC ..... B21F 1/02; B21F 1/023; B21D 3/00; B21D 3/02; B21D 3/04; B21D 3/05
USPC ..... 140/147; 72/160, 162, 164, 165, 240
See application file for complete search history.

(56) References Cited

U.S. PATENT DOCUMENTS 2,369,234 A 2/1945 Illmer
5,676,010 A * 10/1997 College et al. ..... 72/162

FOREIGN PATENT DOCUMENTS

| | | |
|---|---|---|
| EP | 0739066 A2 | 10/1996 |
| EP | 0932462 A1 | 8/1999 |
| EP | 0932462 B1 | 8/1999 |
| WO | 9812005 A1 | 3/1998 |

* cited by examiner

*Primary Examiner* — Debra Sullivan
(74) *Attorney, Agent, or Firm* — Fraser Clemens Martin & Miller LLC; William J. Clemens

(57) ABSTRACT

A straightening apparatus for straightening wires comprises an entry-side roll arrangement and an exit-side roll arrangement, which are arranged so that a wire that is to be straightened, viewed in a transport direction, arrives between rolls of the entry-side roll arrangement in the straightening apparatus and, after passing between rolls of the exit-side roll arrangement, leaves the straightening apparatus, a distance between two rolls of the exit-side roll arrangement being settable. Furthermore, a pre-definable force F acts on the wire perpendicular to the transport direction between two rolls of the entry-side roll arrangement.

8 Claims, 7 Drawing Sheets

WIRE STRAIGHTENING APPARATUS

CROSS-REFERENCE TO RELATED APPLICATION

This application claims priority to European Patent Application No. 10167053.7, filed Jun. 23, 2010, which is incorporated herein by reference.

FIELD

The disclosure relates to a straightening apparatus for straightening wires and a corresponding method.

BACKGROUND

To allow reliable execution of process steps on a wire-processing machine, such as insulation-stripping, crimping, and end-fitting, wires that are straight are important.

To make the wires straight, they are generally pulled, with the aid of the drives that are present in the wire-processing machine, through one or more straightening apparatuses that are mounted at the run-in of the machine. Curvatures and twists in the wires are thereby eliminated.

Known straightening apparatuses can require great outlay to yield a given straightening effect. With the usual straightening apparatuses in wire-processing machines, it can be difficult to reproduce a setting on the same straightening apparatus, or on another straightening apparatus, or on another machine.

Known straightening apparatuses usually have a plurality of rolls, between which the wire that is to be straightened is led. They also employ former solution methods for setting the roll-distance, which can use engraved scales and setting screws, in some cases with counters. In some cases, it is also possible to set the roll-distance automatically by means of an actuator. The rolls of the formerly known straightening apparatuses typically sit on two roll-rails. Setting of the pull-in of the straightening apparatus, i.e. the inclination of one or both roll-rails, usually takes place by tight gripping with screws. Frequently, this setting is performed using a rule of thumb which states that the exit-side rolls of the straightening apparatus should touch the wire. Due to the lack of simple setting possibilities and simple setting criteria, the pull-in is often not changed.

For straightening apparatuses there are therefore to date no known simple, robust criteria or parameters which, for example, can be stored together with a wire, so as to make it possible to optimally set the straightening apparatus on an arbitrary machine according to the wire type.

The rolls of straightening apparatuses that are used today are set with simple means to a certain position that depends on the material that is to be straightened. However, this position is very critical. A small incorrect setting, or a small deviation of the external diameter (e.g. caused by production scatter in the wire manufacture), or of the elasticity in the wire (e.g. depending on the temperature when processing), causes greatly differing straightening results.

Inexpensive straightening apparatuses today are set with a parameter, viz, a feeding movement of a rail with rolls perpendicular to the wire.

A straightening apparatus is described in EP0932462 (see also WO 98/12005). This document proposes arrangement of a first row of rolls perpendicular to the axis of the wire. The pull-in results from the arrangement of a second row of rolls which, through being borne in floating manner, is to a small extent additionally modifiable in its angular position. The change in angle is, however, largely undefined, since it is determined by two compression springs, which also serve to open the straightening apparatus. In addition, the pre-tensioning of these springs is modified by adjustment of the distance between the rows of rolls.

A further straightening apparatus is known from EP 0 739 066 A2. The straightening apparatus according to EP 0 739 066 A2 makes use of roll arrangements which, by swiveling movements, are settable in both horizontal and vertical direction.

SUMMARY

The disclosed embodiments relate in particular to straightening apparatuses for wire-processing machines. The wires, for example, insulation-stripped strands or complete conductors of copper or steel, which are processed on a wire-processing machine, are usually made ready in drums, on rolls, or as bundles, and, for this reason, after unrolling, are often to a greater or lesser extent curved and possessed of twist.

Embodiments of the technologies disclosed herein comprise an entry-side roll arrangement and an exit-side roll arrangement. These roll arrangements are arranged in such manner that, viewed in the direction of transport, a wire that is to be straightened enters into the straightening apparatus between the rolls of the entry-side roll arrangement and, after passing through, leaves the straightening apparatus between rolls of the exit-side roll arrangement, the straightening apparatus being settable in, for example, two degrees of freedom. Settable as first degree of freedom is a distance between two rolls of the exit-side roll arrangement, and specifiable as second degree of freedom is a force that acts perpendicular to the direction of transport on the wire between two rolls of the entry-side roll arrangement.

In former straightening apparatuses it is at least sometimes neglected that, to obtain an optimal straightening result, the aforesaid pull-in should be changed according to the material that is to be straightened. For the first time, at least some embodiments disclosed herein offer the possibility of reproducibly specifying and setting two degrees of freedom.

BRIEF DESCRIPTION OF THE DRAWINGS

The present disclosure is explained in more detail by reference to the attached figures. Shown are in FIG. 1 a first embodiment in a diagrammatic representation.

DETAILED DESCRIPTION

Figure 1:
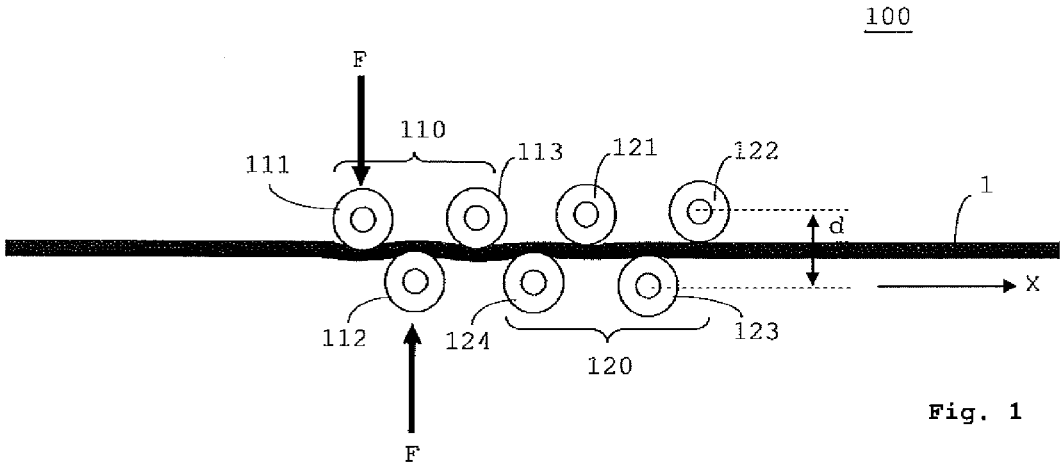
Figure 2:
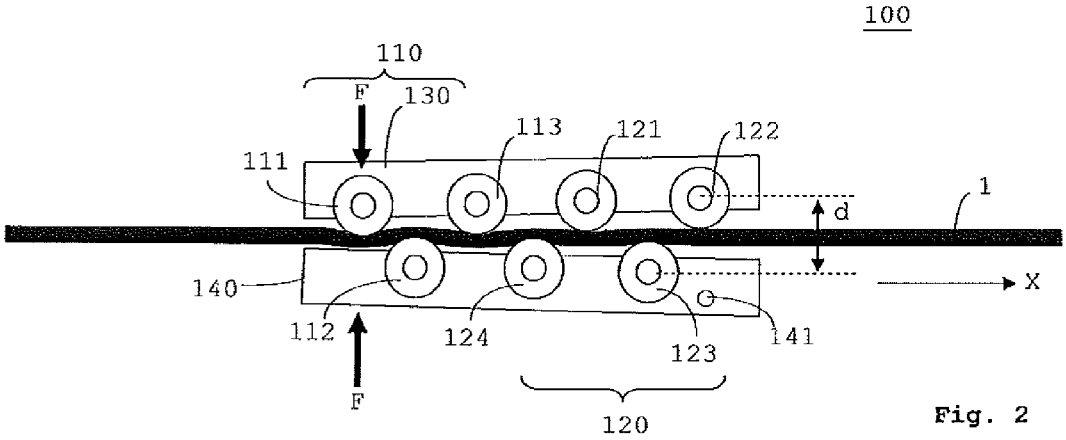
FIG. 2 a second embodiment in a diagrammatic representation.
Figure 3:
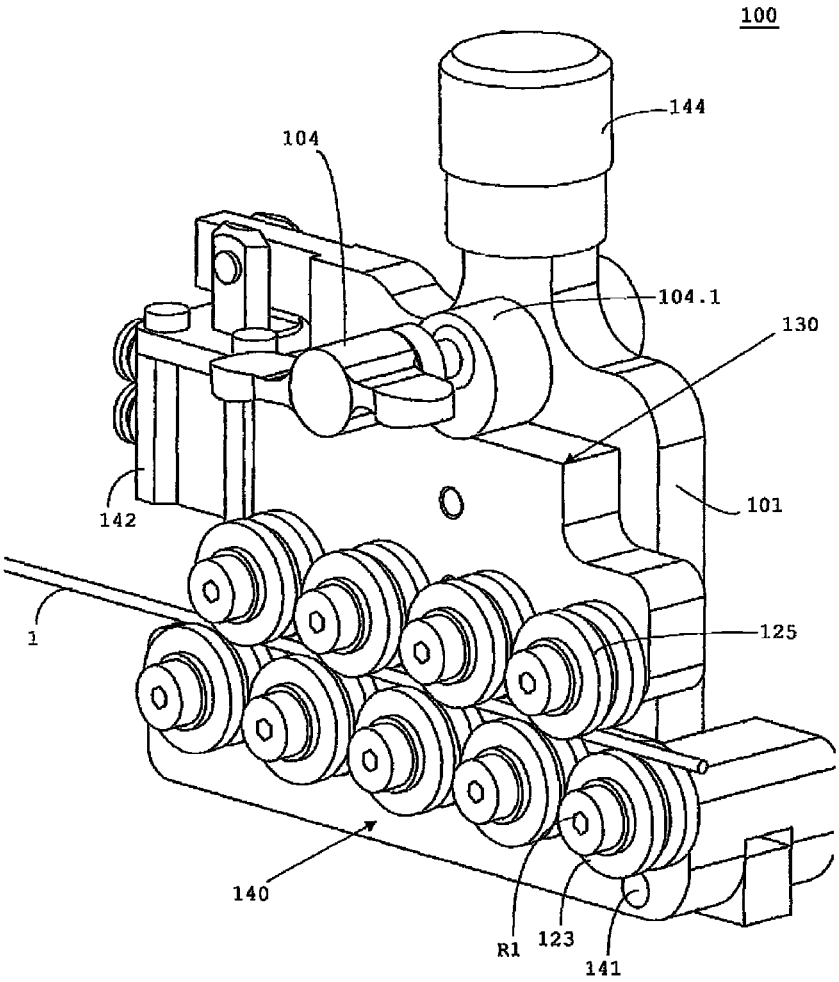
FIG. 3 a diagrammatic three-dimensional representation of an embodiment of a straightening apparatus.

The term "entry-side roll arrangement 110" is used for an arrangement of two, three, or more rolls (e.g. the rolls 111-113 in FIG. 1 or FIG. 2). The term "exit-side roll arrangement 120" is used for an arrangement of two, three, or more rolls (e.g. the rolls 121-124 in FIG. 1 or FIG. 2). "Entry side" means that the corresponding arrangement is one which, in relation to the direction of transport X of the wire 1, is located before the rolls of the exit-side roll arrangement 120. In other words, the wire 1 first runs between the rolls of the entry-side roll arrangement 110, and only then between the rolls of the exit-side roll arrangement 120.

Either the rolls of the entry-side roll arrangement 110 are held by a first pair of distanced roll-plates, and the rolls of the exit-side roll arrangement 120 by a second pair of distanced roll-plates. In this case, the mechanical outlay is, however, generally greater than in an embodiment which is based on the principle shown in FIG. 2, in which a first roll-plate 130 bears some of the rolls (here the rolls 111, 113) of the entry-side roll arrangement 110 and some of the rolls (here the rolls 121, 122) of the exit-side roll arrangement 120, and a second roll-plate 140 bears some other of the rolls (here the roll 112) of the entry-side roll arrangement 110 and some other of the rolls (here the rolls 123, 124) of the exit-side roll arrangement 120.

Generally, the principle shown in FIG. 2 is mechanically simpler to implement, since only the distance d and the force F (which result in a pressure that acts on the wire 1) of the two roll-plates 130, 140 must be moved relative to each other in specifically controlled manner. In an embodiment with, for example, four roll-plates, the setting/adjustment outlay is generally somewhat greater.

Two basic straightening apparatuses 100 which, for the purpose of straightening wires 1, are equipped with an entry-side roll arrangement 110 and an exit-side roll arrangement 120, are shown in FIGS. 1 and 2. The roll arrangements 110, 120 are arranged in such manner that, viewed in the direction of transport X, a wire 1 that is to be straightened arrives in the straightening apparatus 100 between rolls 111, 112, 113 of the entry-side roll arrangement 110. After passing between the rolls 121, 122, 123, 124 of the exit-side roll arrangement 120, the wire 1 leaves the straightening apparatus 100.

In some embodiments the straightening apparatus 100 is particularly characterized in that it is settable in two degrees of freedom d, F. This settability can be selected or designed so that the settability is reproducible, i.e. is generally reconstructable at any time based on instructions.

The various embodiments of the disclosed technologies can also have more rolls, or fewer rolls, than shown in the figures.

Described below are embodiments that were all derived from the principle that is shown in FIG. 2. The technical theory of this embodiment can, however, also be transferred to the principle of FIG. 1.

Figure 4A:
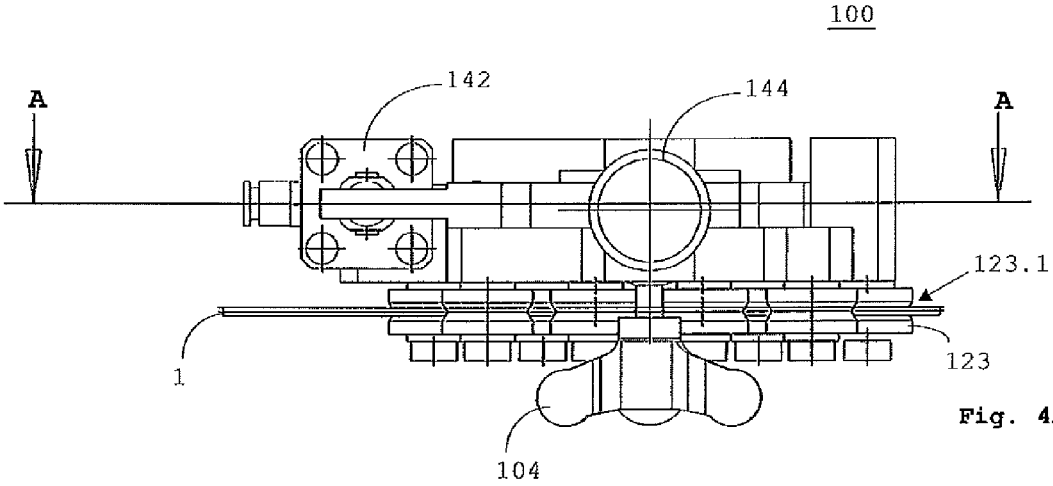
FIG. 4A a diagrammatic plan view of the straightening apparatus according to FIG. 3.

The straightening apparatus 100 can comprise a baseplate 101, arranged on which are an upper roll-plate 130 and a lower roll-plate 140. In their starting state, the rolls of the two roll-plates 130, 140 are each arranged parallel to an ideal wire-axis (which lies parallel to the direction of transport X) of a wire 1. The rolls possibly have in the center a continuous circumferential groove. In FIG. 4A, for example, the groove 123.1 of the roll 123 is indicated by an arrow.

It should be noted that, in FIGS. 3 to 9B, in each case only those rolls are provided with reference numbers to which reference is made in the current description. As already mentioned, the number of rolls can vary, depending on the embodiment. The assignment of the rolls to the entry-side roll arrangement 110, and to the exit-side roll arrangement 120, relates at least to the first two or three entry-side rolls 111, 112, 113, and to the last two or three exit-side rolls 121, 122, 123.

In at least some embodiments, the rolls can be arranged mutually offset. They can be in sequence of, for example, an upper roll 111, then diagonally a lower roll 112, and then diagonally an upper roll 113, etc. The number of the lower rolls 112, 124, 123 can be one less than the number of the upper rolls 111, 113, 121, 122 (e.g. above four rolls, and below three rolls, as in FIGS. 1 and 2), or vice versa (e.g. above four rolls, and below five rolls, as in FIG. 3).

Figure 4B:
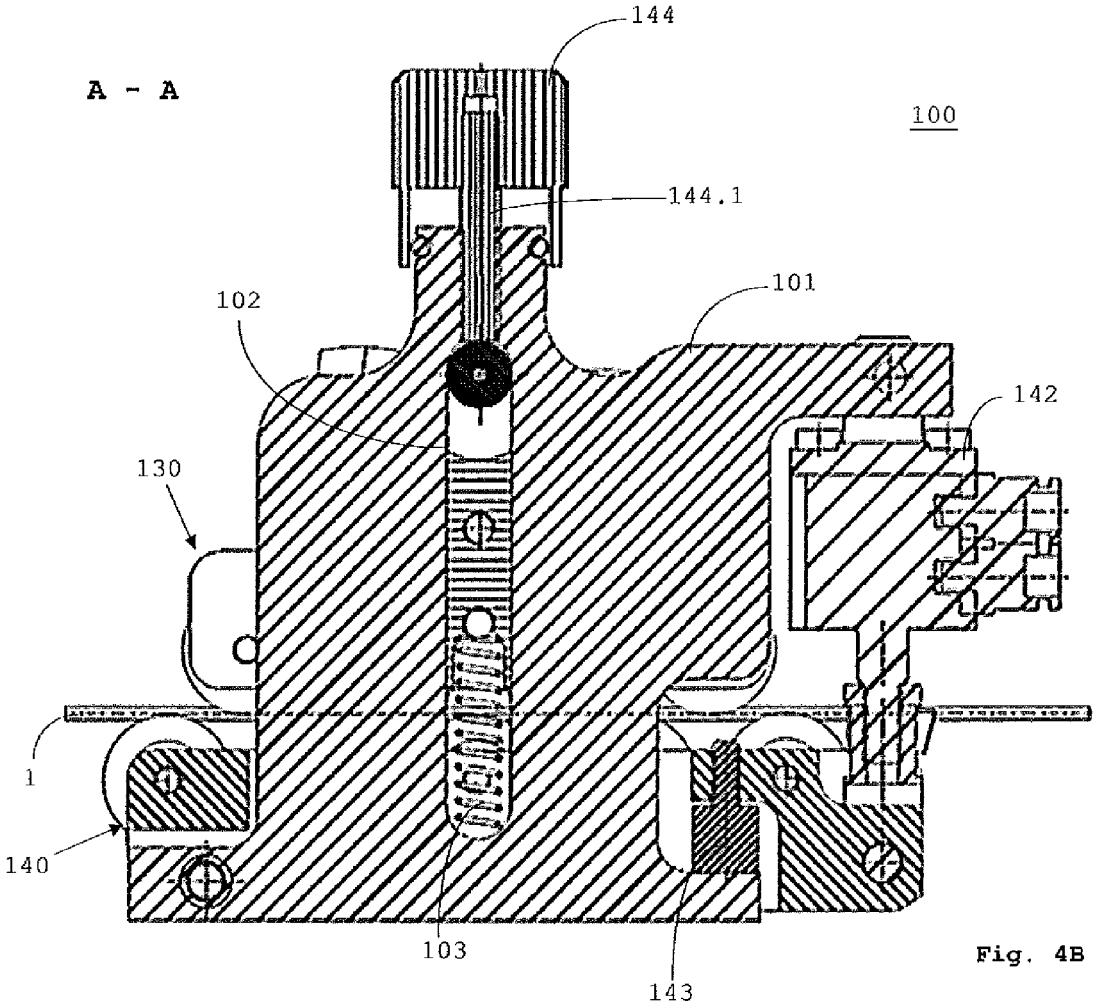
FIG. 4B a diagrammatic cross section along the axis A-A of the straightening apparatus according to FIG. 4A.

The upper roll-plate 130 can be led with a guide 102 perpendicular to the wire-axis (direction of transport X) on the baseplate 101, as can be seen in the cross-sectional representation in FIG. 4B. It can be pressed into the open state (i.e. here upwards) with a spring 103. A rapid-clamping lever 104 with eccentric 104.1, or a corresponding automatically operable eccentric element, can serve to rapidly open and close the upper roll-plate 130. "Opening" is the designation given to a relative movement which results in the distance between the upper roll-plate 130 and the lower roll-plate 140 being enlarged. "Closing" is the designation given to an opposite relative movement. During "opening" and "closing", the respective roll-plates 130, 140 move synchronously.

The rapid-clamping lever 104, the eccentric 104.1, and the upper roll-plate 130 are, for example, displaced with a setting wheel or a setting screw 144 via a spindle 144.1 (see FIG. 4B) perpendicular to the wire-axis (direction of transport X).

The lower roll-plate 140 is swivelable about an off-center axis 141. This axis 141 possibly lies close to the axis of rotation R1 of the final roll 123 of the exit-side roll arrangement 120. Generally, the closer the axis 141 sits to the axis of rotation R1 of the final roll 123, the less the distance d of the two final rolls 122, 123 changes when a slight swiveling movement of the lower roll-plate 140 about the axis 141 takes place.

In another embodiment, the axis 141 and the axis of rotation R1 of the final roll 123 coincide. In this case, the distance d does not change when the lower roll-plate 140 executes a slight swiveling movement about the axis 141.

Figure 5:
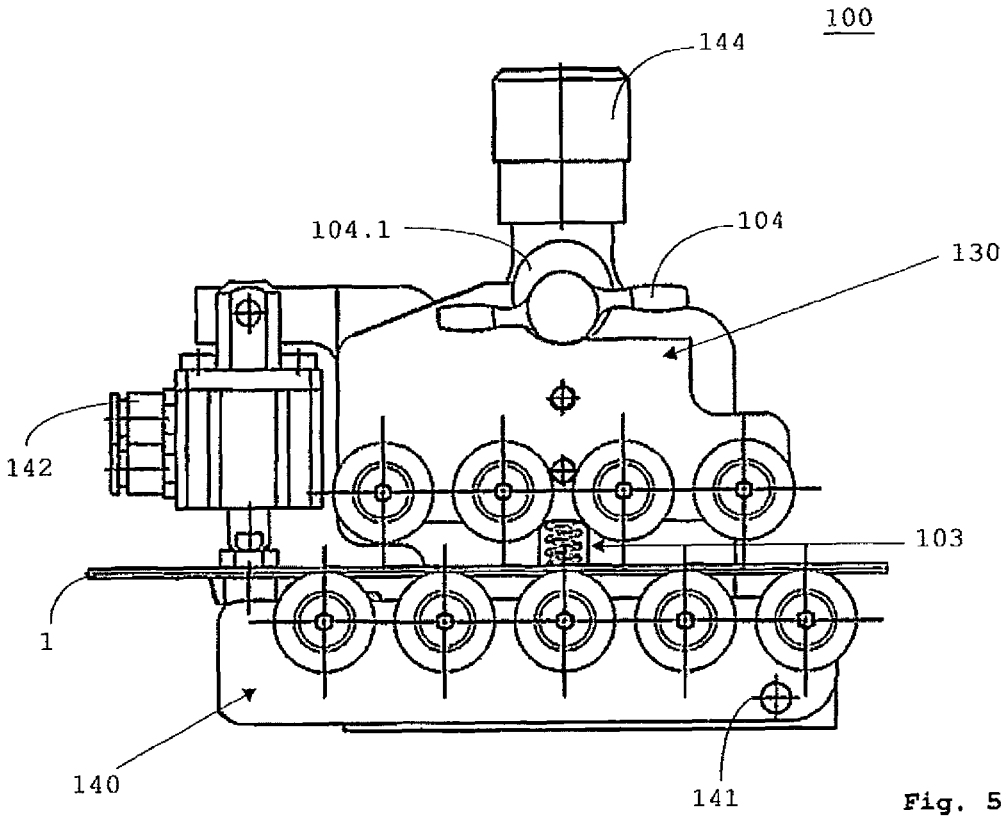
FIG. 5 a diagrammatic side-view of an embodiment of a straightening apparatus in an open state.

The aforesaid swiveling movement about the axis 141 is executed to determine on the entry-side a force F, as can be seen, for example, in FIG. 2 or FIG. 5.

To pull the roll-plate 140 upwards, a pneumatic cylinder 142, for example, can be used. By the aforesaid turning movement about the axis 141, the lower roll-plate 140 is thereby set diagonal relative to the upper roll-plate 130, and the entry-side rolls press on the wire 1, which is pulled through the straightening apparatus 100. The apparatus 100 thereby exercises a reducing straightening effect in the direction of transport X (direction of pull) of the wire 1 from the first roll 111 to the final roll 122. If the cylinder 142 acts in the opposite direction, the lower roll-plate 140 is moved parallel to the upper roll-plate 130 to a stop 143 into the starting position. The pneumatic cylinder 142 can be controlled by the wire-processing machine or straightening apparatus 100 via a valve. The pressure of the cylinder 142, and hence also the force F is, for example, set via a pressure regulator.

An exemplary embodiment of the functional principle is explained below.

The straightening apparatus 100 has three positions:

1. Open, when the two roll-plates 130 and 140 are set so that none of the rolls touches the wire 1 (see FIG. 5).
2. Closed, when the roll-plates 130 and 140 are aligned parallel, and the rolls touch the wire 1 (see FIG. 6).
3. Active, when the roll-plates 130 and 140 on the side of the first roll 111 (i.e. on the entry side) are pressed together with a force F, so that the wire 1 is straightened as it passes through (see FIG. 7).

The wire-processing machine, or the straightening apparatus 100, possibly sets the two roll-plates 130, 140 parallel with the pneumatic cylinder 142. The operator, or a control, opens the straightening apparatus 100 with the rapid-clamping lever 104 and inserts the wire 1. The operator, or a control, then closes the straightening apparatus 100 with the rapid-clamping lever 104 and sets, for example with the setting screw 144, the upper roll-plate 130 so that all rolls of the apparatus 100 exactly touch the wire 1 (see FIG. 6). The operator, or a control, can recognize this in that, for example, the wire 1 starts to bend. Alternatively, or additionally, during closing, the wire 1 can be moved backwards and forwards until the rolls turn with the wire 1. The instant can thus be recognized which corresponds to the closed position 2 (see FIG. 6).

With a pressure regulator, the operator or a control sets the pressure of the pneumatic cylinder 142 based on specifications (e.g. based on a table, or based on data from a storage medium) for the stretched-in wire 1. The pressure of the pneumatic cylinder 142 corresponds to a force F, as described.

Before the wire-processing machine, or the straightening apparatus 100, transports the wire 1 in the direction of transport X, the pneumatic cylinder 142 is brought into the upper position (referred to as "active position"), whereby the straightening apparatus 100 is active, and the wire 1 is bent by the upper and lower rolls in alternate directions, and decreasingly in the direction of wire-transport X, from the first roll 111 to the final roll 122. As the wire 1 is pulled through the straightening apparatus 100, it is now straightened in a defined manner.

When, after straightening, the wire 1 becomes stationary again, the wire-processing machine or straightening apparatus 100 can move the roll-plates 130, 140 apart again and set them parallel (referred to as "open position"), so that the wire 1 can be de-tensioned and removed.

The embodiments described hitherto can be modified, for example, as follows.

As already indicated, the axis of rotation 141 of the roll-plate 140 can assume another position. If the axis of rotation 141 of the lower roll-plate 140 coincides with the axis of rotation R1 of the final roll 123, the final roll 123 touches the wire 1 at all angular settings, or rotational settings, of the lower roll-plate 140, provided that in Step 2 the closed setting was moved to/set. This principle can be applied to one or more embodiments disclosed herein.

In some cases, to ensure that, even in the case of a slightly faulty setting of the upper roll plate 130, the final roll 123 no longer bends the wire 1, the axis of rotation 141 can be located below the axis of rotation R1 of the roll 123.

Similar to the lower roll-plate 140, the upper roll-plate 130 can be provided with an axis of rotation which coincides with the roll-axis of the final roll 125 of the upper roll-plate 130, or lies in the vicinity of this roll 125 in FIG. 3A, with the possible advantage that the wire 1, on entry to the straightening apparatus 100, is symmetrically loaded. This principle can be applied to one or more disclosed embodiments.

Figure 6:
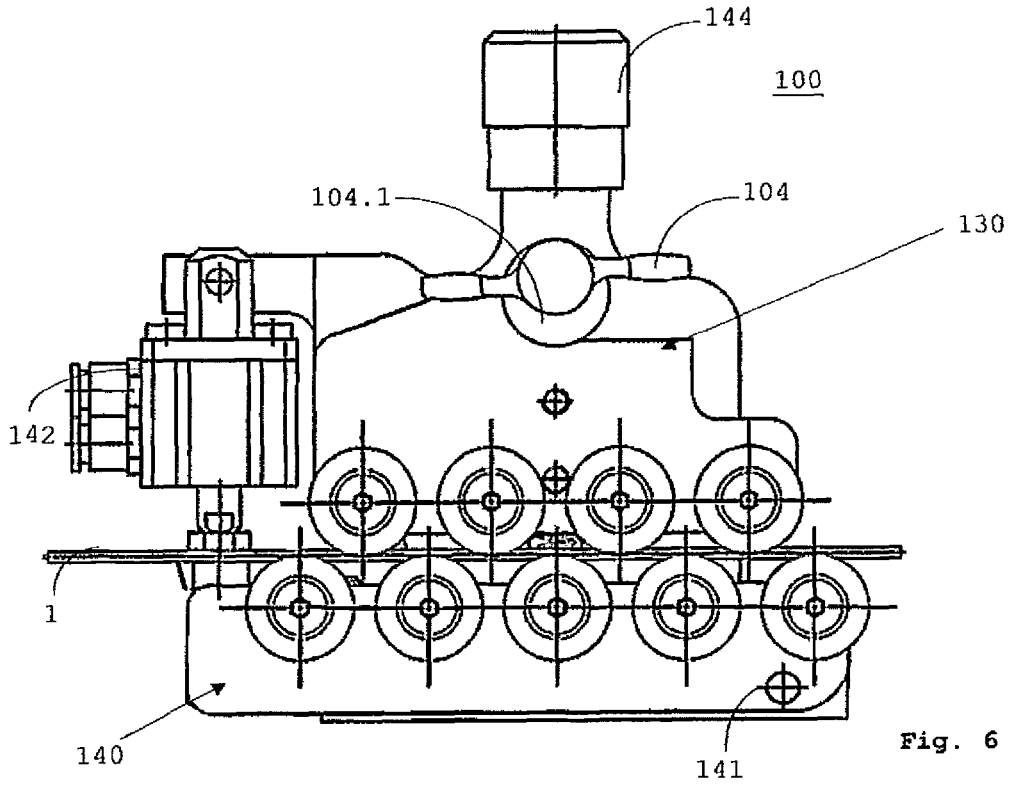
FIG. 6 a diagrammatic side-view of an embodiment of a straightening apparatus in a closed state.
Figure 7:
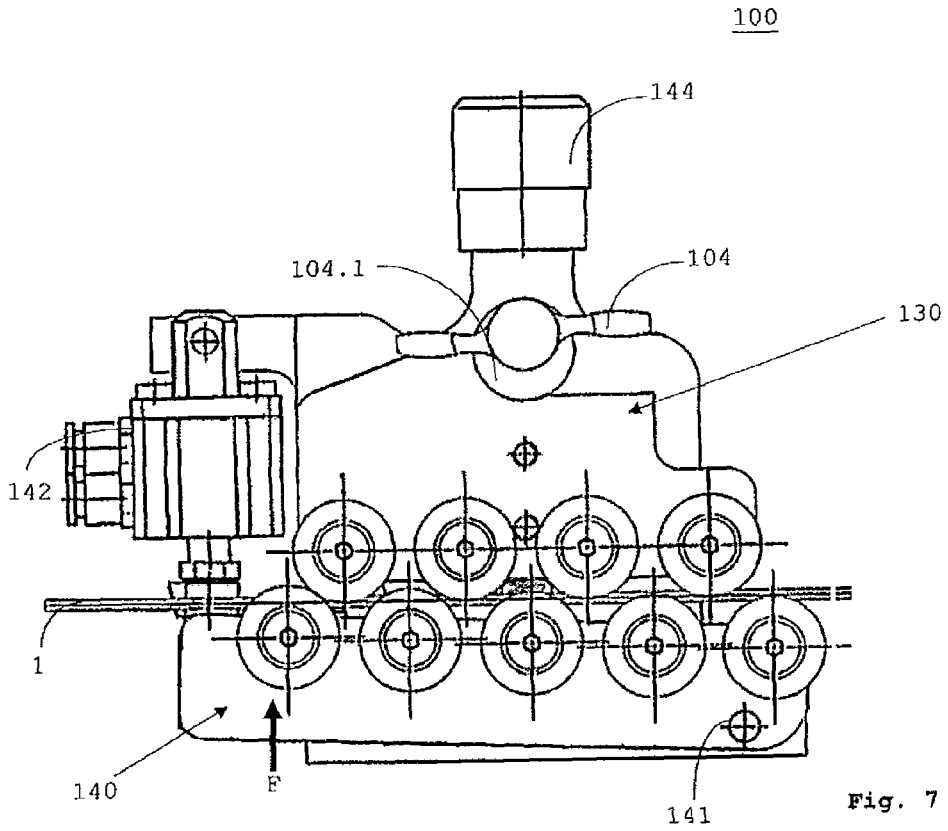
FIG. 7 a diagrammatic side-view of an embodiment of a straightening apparatus in an active state.

As explained below, it is possible for the upper roll-plate 130 to be provided with a setting aid. If the external diameter of the wire 1 is known, the upper roll-plate 130 can be brought into a defined position, e.g. with a scale, which is inscribed for various wire dimensions, or with a sensor, which measures the distance of the two roll-plates 130, 140 from each other. A position transducer or distance sensor can be used as sensor. As shown in FIG. 6, the setting aid can allow the transition from the open setting into the closed setting to be made reproducible. This principle can be applied to one or more disclosed embodiments.

Figure 8:
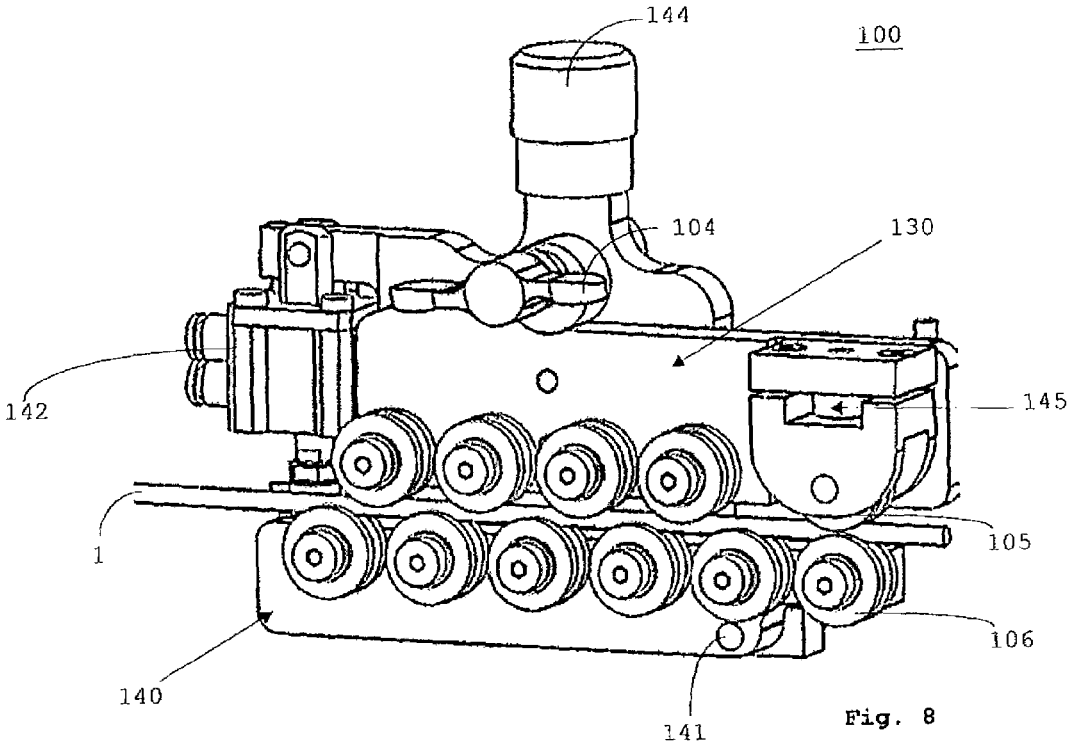
FIG. 8 a diagrammatic three-dimensional view of a further embodiment of a straightening apparatus.
Figure 9A:
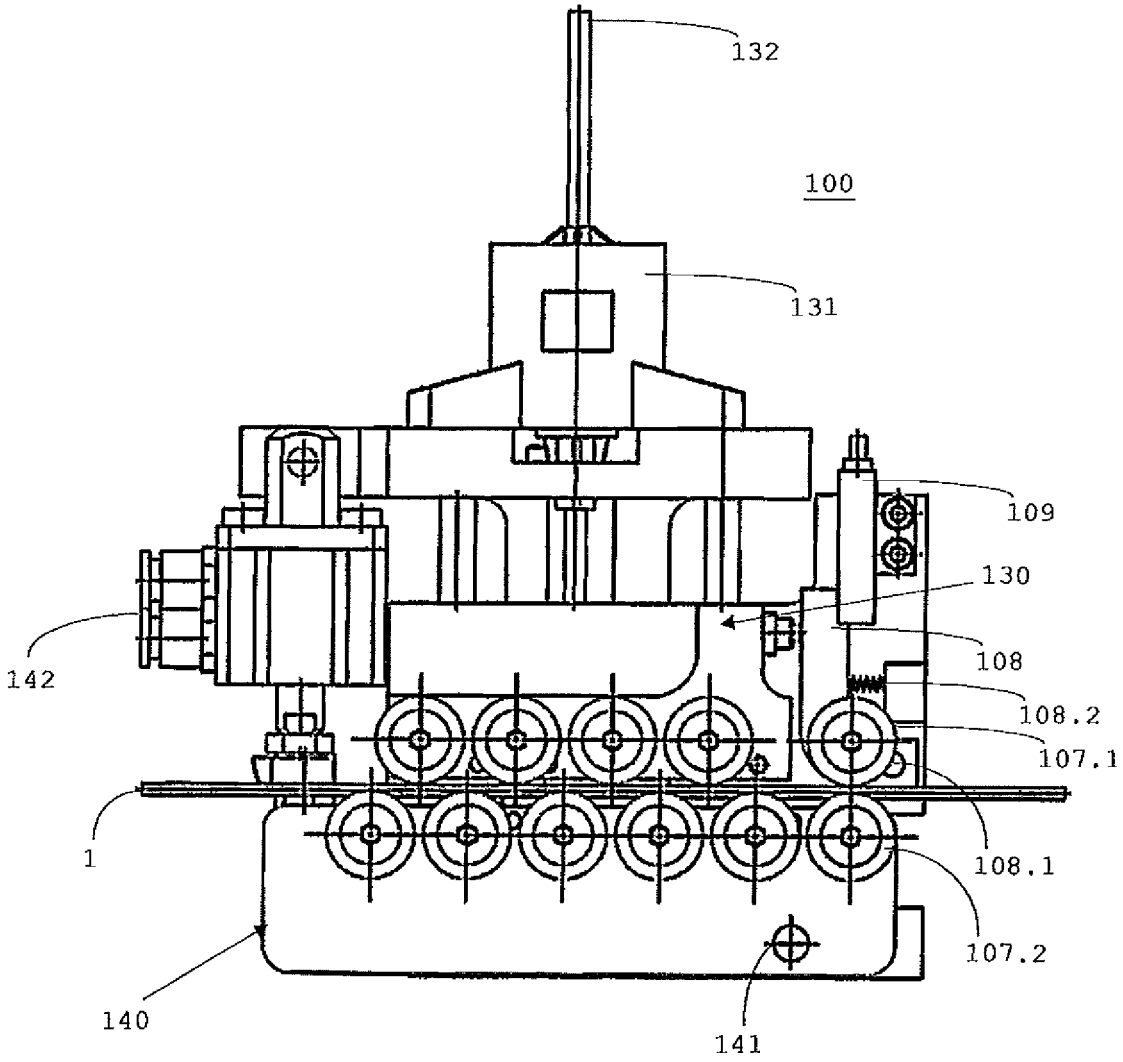
FIG. 9A a diagrammatic side view of a further embodiment of a straightening apparatus.
Figure 9B:
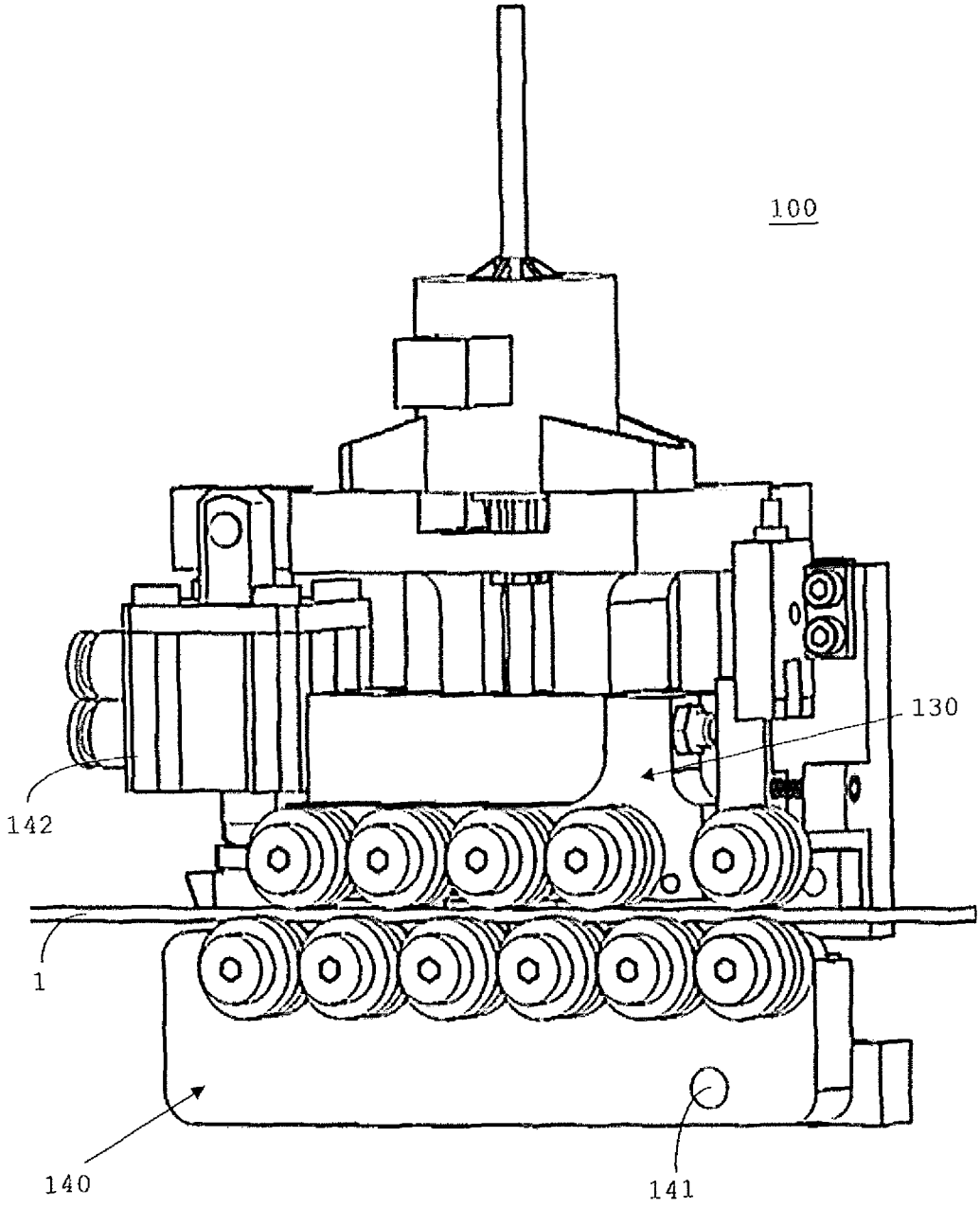
FIG. 9B a diagrammatic three-dimensional view of the straightening apparatus according to FIG. 9A.

Depending on the embodiment, a force sensor 145 can be provided as shown in FIG. 8. A force sensor 145 can be built in which allows measurement of whether the wire 1 is touching the rolls, or the rolls touching the wire 1, respectively. For example, a force sensor 145 can measure the contact via a measurement roll 105 and a counter roll 106. The rolls 105 and 106 can touch the wire 1 in a line with the other rolls of the respective roll-plate 130, 140. This principle can be applied to one or more disclosed embodiments.

Depending on the embodiment, a position sensor can be provided. A corresponding roll 107.1 can be mounted on a lever 108, which, via an axle 108.1, is rotatably fastened to the roll-plate 130. With a spring 108.2, or through gravity, the lever 108 is pressed in the direction of an oppositely lying roll 107.2. Through the contact with the wire 1, the roll 107.1 is moved into the line of the other rolls of the upper roll-plate 130. A sensor which is fastened on the roll-plate 130 (e.g. a fork light-barrier 109) emits a signal if the roll 107.1, which touches the wire 1, is located in a line with the other rolls of the upper roll-plate 130, and therefore all of the rolls touch the wire 1. This principle can be applied to one or more disclosed embodiments.

Instead of, or in addition to, a sensor (e.g. a fork light-barrier 109), a marking can also be applied to the upper roll-plate 130, which, on manual setting, shows the correct position of the lever 108. This principle can be applied to one or more disclosed embodiments.

Possibly, a return of sensor data into the straightening apparatus 100 is applied. In this manner, a closed-loop, or active, control circuit can be established. For this purpose, the sensor signals of the force sensor or position sensor can be fed into, for example, a machine control of the straightening apparatus 100 and/or of the wire-processing machine, which monitors the measurement values and, in case of faulty settings, for example, warns the user and blocks the wire processing. This principle can be applied to one or more disclosed embodiments.

In some cases, a feeding mechanism of the upper roll-plate 130 is used. The upper roll-plate 130 can be moved by motor, e.g. with a motor 131 with spindle 132. The motor drive can be coupled with one of the said sensors (e.g. 145 and/or 109), to automatically travel to the optimal position, in which both the distance d and the force F match the specified values.

The feeding force or pressure that is responsible for creating the force F can, in one or more embodiments, be applied also to the lower roll-plate 140, or both roll-plates 130, 140 can have applied to them a partial force.

To specify the force F, instead of a manual pressure regulator, in each embodiment also a pressure-regulating valve can be used, which can be controlled by the wire-processing machine or the straightening apparatus 100. The wire-processing machine or the straightening apparatus 100 can maintain a table (e.g. in a storage medium), in which the optimal force F for the various types of wire, or the corresponding setting of the pressure-regulating valve, or of the cylinder of the apparatus 100, is stored. In this case, setting of the pressure takes place at least partially automatically or fully automatically as soon as the wire-type of the wire-processing machine, or of the straightening apparatus 100, is known.

In at least some embodiments, the force F can also be varied during the wire transport so as to straighten the wire 1 more or less strongly in various sections.

At least some of the disclosed embodiments offer an array of advantages, which have already been described or otherwise indicated. Example advantages of the straightening apparatus 100 can include:

Easily settable parameters, which allow an optimal (manual or automatic) setting.

The parameter that defines the force F is insensitive, i.e. even with a slight deviation from the optimal force setting (through faulty setting, manufacturing tolerances, or deviating material characteristics), the straightening effect of the straightening apparatus 100 does not deviate far from the optimum.

The roll-distance parameter d at the exit can be derived objectively, and very easily, from the geometrical data of the material that is to be straightened (of the wire 1). In at least some cases, a faulty setting is therefore unlikely.

Both parameters F and d are objectively measurable and settable (manually or automatically).

Both parameters F and d are independent of a certain wire-processing machine or of a certain straightening apparatus 100. The setting data can therefore be defined once and stored along with the wire type (e.g. in a storage medium). These setting data can be used with reproducible effect at an arbitrary point in time on an arbitrary wire-processing machine or straightening apparatus 100.

In certain operating states, it is possible to reduce the entry-side force F, for example in the case of a stationary wire 1, so as to avoid an undesired deformation in wire 1 or, at high speed, to reduce the necessary drive-power in the wire-advance. The wire 1 is nevertheless well-led between the rolls of the straightening apparatus 100.

At least some embodiments of the straightening apparatus 100 can be inexpensively designed and constructed, and existing wire-processing machines can be easily retrofitted.

In at least some embodiments, the entry-side rolls of the straightening apparatus 100, which often exercise the greatest straightening effect, are always located in an ideal position.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. I therefore claim as my invention all that comes within the scope and spirit of these claims.

I claim:

1. A wire-straightening apparatus, comprising:

a first roll arrangement comprising a first set of rolls;

a second roll arrangement comprising a second set of rolls;

an upper common roll-plate coupled to a first portion of the first set of rolls and a first portion of the second set of rolls; and a lower common roll-plate coupled to a second portion of the first set of rolls and a second portion of the second set of rolls, a distance between the first portion of the second set of rolls and the second portion of the second set of rolls being adjustable, wherein the upper common roll-plate is movable in a direction perpendicular to a wire axis and the upper and lower common roll-plates are configured to be generally parallel in a closed state such that the first and second sets of rolls receive a wire, and wherein at least two rolls of the first set of rolls are configured to apply a force to the wire, the force being received by the at least two rolls of the first set of rolls through the upper and lower common roll-plates, respectively, the lower common roll-plate being swivelable relative to the upper common roll-plate about an axis of rotation to adjust the force applied to the wire.

2. The wire-straightening apparatus of claim 1, the upper and lower common roll-plates being movably coupled to a baseplate.

3. The wire-straightening apparatus of claim 1, further comprising a clamping lever configured to adjust the distance between the first portion of the second set of rolls and the second portion of the second set of rolls.

4. The wire-straightening apparatus of claim 1, further comprising a clamping lever configured to adjust the force applied to the wire.

5. The wire-straightening apparatus of claim 1, further comprising at least one sensor, the at least one sensor being configured to determine if the first roll arrangement or the second roll arrangement is touching the wire.

6. The wire-straightening apparatus of claim 1, further comprising at least one sensor, the at least one sensor being configured to determine if a roll of the first set of rolls or a roll of the second set of rolls touches the wire.

7. A wire processing machine comprising:

a wire-straightening apparatus, the wire-straightening apparatus comprising, a first roll arrangement comprising a first set of rolls, a second roll arrangement comprising a second set of rolls, an upper common roll-plate coupled to a first portion of the first set of rolls and a first portion of the second set of rolls, and a lower common roll-plate coupled to a second portion of the first set of rolls and a second portion of the second set of rolls, a distance between the first portion of the second set of rolls and the second portion of the second set of rolls being adjustable, wherein the upper common roll-plate is movable in a direction perpendicular to a wire axis and the upper and lower common roll-plates are configured to be generally parallel in a closed state such that the first and second sets of rolls receive a wire, and wherein at least two rolls of the first set of rolls are configured to apply a force to the wire, the force being received by the at least two rolls of the first set of rolls through the upper and lower common roll-plates, respectively, the lower common roll-plate being swivelable relative to the upper common roll-plate about an axis of rotation to adjust the force applied to the wire.

8. A wire-processing method, comprising:

placing a wire between a set of rolls attached to an upper roll-plate and a set of rolls attached to a lower roll-plate, wherein the upper roll-plate is movable in a direction perpendicular to a wire axis;

placing the set of rolls attached to the upper roll-plate and the set of rolls attached to the lower roll-plate in contact with the wire by adjusting a distance between the upper and lower roll-plates by swivelling the lower roll-plate relative to the upper roll-plate about an axis of rotation to adjust a force applied to the wire, the upper and lower roll-plates being generally parallel to each other;

applying the force to the wire with at least one roll of the set of rolls attached to the upper roll-plate and at least one roll of the set of rolls attached to the lower roll-plate; and rotating the set of rolls attached to the upper roll-plate and the set of rolls attached to the lower roll-plate.

* * * * *